US011089858B1

(12) United States Patent
Park

(10) Patent No.: US 11,089,858 B1
(45) Date of Patent: Aug. 17, 2021

(54) SOFT WIPER ASSEMBLIES

(71) Applicant: L'Oreal, Paris (FR)

(72) Inventor: Kyoo Jin Park, Leonia, NJ (US)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 16/862,921

(22) Filed: Apr. 30, 2020

(51) Int. Cl.
*A45D 34/04* (2006.01)
*A45D 40/26* (2006.01)

(52) U.S. Cl.
CPC ..... *A45D 34/046* (2013.01); *A45D 40/267* (2013.01)

(58) Field of Classification Search
CPC .. A45D 34/046; A45D 34/047; A45D 30/045; A45D 40/265; A45D 40/267; A45D 40/268; A45D 2200/05
USPC ..... 401/121–130
See application file for complete search history.

(56) References Cited

U.S. PATENT DOCUMENTS 3,146,806 A * 9/1964 Ginsburg ..... A61M 31/00 141/110
4,194,848 A * 3/1980 Kingsford ..... A45D 34/047 401/5
5,137,387 A * 8/1992 Byrd ..... A45D 40/267 401/122
5,349,972 A * 9/1994 Dirksing ..... A45D 40/267 132/218
7,967,519 B2 * 6/2011 Gueret ..... A45D 40/267 401/122
8,221,015 B2 7/2012 Gueret
8,403,580 B2 * 3/2013 De Laforcade ..... A45D 40/267 401/129
8,528,572 B2 9/2013 Schwab et al.
9,289,048 B2 3/2016 Wilczynski

FOREIGN PATENT DOCUMENTS

DE 102008053905 B4 4/2015
EP 1771099 B1 12/2007
EP 2106222 B1 8/2012
EP 2574253 B1 8/2017
FR 2888097 A1 1/2007
WO 2018206364 A1 11/2018

OTHER PUBLICATIONS

Preliminary Search Report dated Apr. 21, 2021 for French Patent Application No. 2008819, filed on Aug. 31, 2020, 2 pages.
Written Opinion dated Apr. 21, 2021 for French Patent Application No. 2008819, filed on Aug. 31, 2020, 6 pages.

* cited by examiner

*Primary Examiner* — David J Walczak
(74) *Attorney, Agent, or Firm* — Christensen O'Connor Johnson Kindness PLLC

(57) ABSTRACT

Product lines, cosmetic products, packaging systems, and wiper assemblies improve the distribution, quantity, and/or location of formulation on an applicator. The wiper assemblies include a wiper base portion and a soft wiping portion. The wiper base portion has a body configured to be disposed in a mouth of a container, the body having a lower flange portion and an outer wall defining a cavity. The soft wiping portion has an annular shape and is disposed in the cavity.

17 Claims, 6 Drawing Sheets

SOFT WIPER ASSEMBLIES

SUMMARY

Cosmetic formulations are often applied by being loaded onto an applicator. In some cases, a cosmetic product includes a container storing a cosmetic formulation, and an applicator is stored inside the container such that a brush or other portion of the applicator is disposed in the formulation. When the applicator is withdrawn from the container, the portion previously disposed in the formulation comes out loaded with the formulation, ready for application. In withdrawing the applicator from the container, the applicator passes through a wiper assembly configured to remove excess formulation and to better distribute the formulation on the applicator.

The present disclosure provides product lines, cosmetic products, packaging systems, and wiper assemblies which advantageously improve the distribution, quantity, and/or location of formulation on an applicator.

In an aspect, the present disclosure provides wiper assemblies for a packaging system. The wiper assemblies include a wiper base portion and a soft wiping portion. The wiper base portion has a body configured to be disposed in a mouth of a container, the body having a lower flange portion and an outer wall defining a cavity. The soft wiping portion is disposed in the cavity, and has an annular shape. In some embodiments, a radially inner surface of the soft wiping portion has a Shore durometer ranging from 10 OO to 40 A, inclusive (e.g., 15 OO to 30 A). In some embodiments, the wiper assembly includes a guide portion disposed in the cavity on an opposite side of the soft wiping portion from the lower flange portion. In some embodiments, the guide portion has a tapered inner surface. In some embodiments, the wiper assemblies have one or more of the features below.

In some embodiments, the lower flange portion has a first inner diameter, the soft wiping portion has a second inner diameter that is smaller than the first inner diameter, and the tapered inner surface of the guide portion tapers to a third inner diameter, wherein the first inner diameter and the third inner diameter are 0.1 mm to 1.0 mm greater than the second inner diameter. In some embodiments, the first inner diameter is different from the third inner diameter.

In some embodiments, the soft wiping portion has a chamfered or rounded inner edge facing toward an upper end of the body.

In some embodiments, the lower flange portion has a first inner diameter, and the soft wiping portion has a second inner diameter that is smaller than the first inner diameter.

In some embodiments, the first inner diameter is 0.1 mm to 1.0 mm greater than the second inner diameter.

In some embodiments, the first inner diameter is not more than thirty percent greater than the second inner diameter.

In some embodiments, the soft wiping portion has a thickness between 1 mm and 4 mm, the second inner diameter is between 3.0 mm and 6.0 mm, wherein the first inner diameter is 0.1 mm to 1.0 mm greater than the second inner diameter.

In some embodiments, the soft wiping portion is formed from a thermoplastic elastomer, such as styrene-ethylene-butylene-styrene (SEBS) or thermoplastic polyester elastomers (e.g., HYTREL®).

In some embodiments, the wiper base portion, the soft wiping portion, and the guide portion are three separate components.

In some embodiments, the wiper base portion and the soft wiping portion are integrally formed as a single integrally-formed part. In some embodiments, the single integrally-formed part includes a guide portion disposed in the cavity on an opposite side of the soft wiping portion from the lower flange portion. In some embodiments, the single integrally-formed part is an overmolded part.

In another aspect, the present disclosure provides packaging systems including a container configured to store a formulation, and a wiper assembly disposed in the container. The wiper assembly has any one or more of the features of the wiper assemblies described above. In some embodiments, the packaging system includes a guide portion disposed in the cavity on an opposite side of the soft wiping portion from the lower flange portion. In some embodiments, the guide portion has a tapered inner surface that tapers down to a diameter that is 0.1 mm to 1.0 mm greater than an inner diameter of the soft wiping portion. In some embodiments, the lower flange portion has a first inner diameter, the soft wiping portion has a second inner diameter, and the tapered inner surface of the guide portion tapers down to a third inner diameter, wherein the first inner diameter and the third inner diameter are 0.1 mm to 1.0 mm greater than the second inner diameter.

In another aspect, the present disclosure provides cosmetics product including a packaging system and a cosmetic formulation disposed in a container of the packaging system. The packaging system has any one or more of the features of the packaging systems described above. In some embodiments, the cosmetic product includes a guide portion disposed in the cavity on an opposite side of the soft wiping portion from the lower flange portion, wherein the guide portion has a tapered inner surface, wherein the lower flange portion has a first inner diameter, the soft wiping portion has a second inner diameter, and the tapered inner surface of the guide portion tapers to a third inner diameter, wherein the first inner diameter and the third inner diameter are 0.1 mm to 1.0 mm greater than the second inner diameter.

In another aspect, the present disclosure provides product lines of cosmetic products, including a first cosmetic product and a second cosmetic product. Each of the first and second cosmetic products has one or more of the features of the cosmetic products described above. The first cosmetic product includes a first cosmetic formulation and a packaging system for the first cosmetic formulation. The packaging system for the first cosmetic formulation includes a first container and a first wiper assembly disposed in the first container. The first wiper assembly includes a wiper base portion having a body disposed in a mouth of the first container, the body having a lower flange portion and an outer wall defining a cavity, and a soft wiping portion disposed in the cavity, the soft wiping portion having an annular shape with a radially inner surface having a Shore durometer ranging from 10 OO to 40 A, inclusive (e.g., 15 OO to 30 A). The second cosmetic product includes a second cosmetic formulation different from the first cosmetic formulation and a packaging system for the second cosmetic formulation. The packaging system for the second cosmetic formulation includes a second container different from the first container, and a second wiper assembly disposed in the second container, the second wiper assembly being the same as the first wiper assembly.

BRIEF DESCRIPTION OF THE SEVERAL VIEWS OF THE DRAWINGS

The foregoing aspects and many of the attendant advantages of the claimed subject matter will become more readily appreciated by reference to the following detailed description, when taken in conjunction with the accompanying drawings, wherein:

DETAILED DESCRIPTION

The present disclosure provides product lines, cosmetic products, packaging systems, and wiper assemblies which advantageously improve the distribution, quantity, and/or location of formulation on an applicator. For example, the inventive wiper assemblies cause micro-scale effects on a formulation-loaded applicator that contribute to a better user experience, including more even formulation application and improved feel. Features of the wiper assemblies that provide these advantages include: unique combinations of wiper portions; wiper portions having unique material properties not found in known wipers; wiper portions having unique dimensional relationships with other wiper portions; wiper portions having unique shapes and structural features; and combinations of these features.

Figure 1:
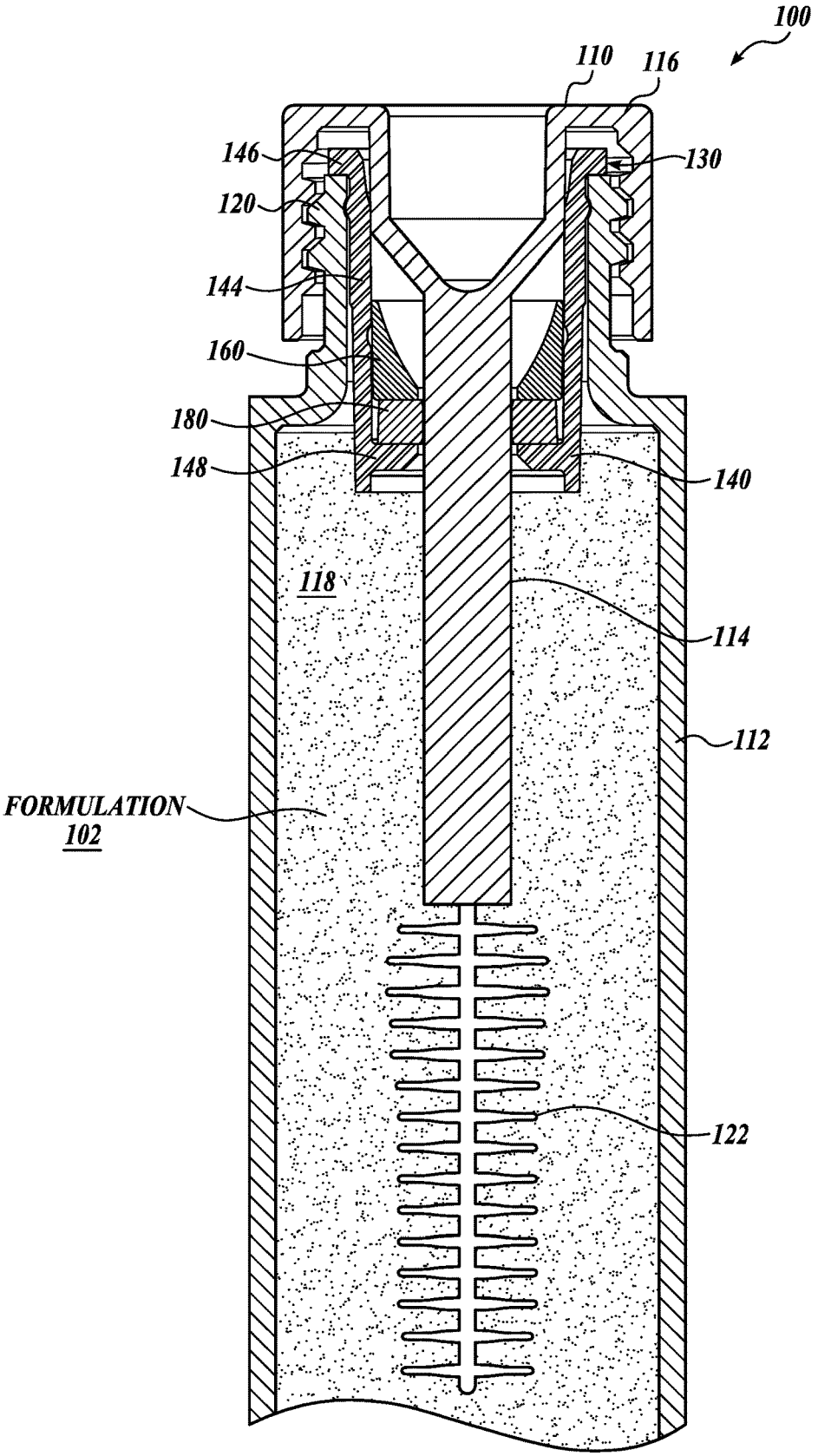
FIG. 1 shows a front elevation section view of a cosmetic product according to one representative embodiment of the present disclosure.

FIG. 1 shows one representative embodiment of a cosmetic product 100 in accordance with the present disclosure, such as may be made, used, and/or sold individually and/or as part of a product line that includes a plurality of such cosmetic products having common features described below.

The cosmetic product 100 includes an optional formulation 102 contained within a packaging system 110. In some embodiments, a product line includes a plurality of cosmetic products 100, each having a packaging system 110 with common elements. In some embodiments, the packaging systems 110 of the product line contain different formulations 102, for example different mascaras. In some embodiments, the packaging systems 110 of the product line contain different containers, but a common wiper assembly as described below. It will become apparent that such product lines are innovative and unobvious because they are improved by the wiper assemblies described below, even though those product lines include different formulations 102 and/or different containers.

Suitable formulations 102 include but are not limited to cosmetic formulations, including: eye makeup such as mascara or eye shadow, eyebrow makeup, face makeup such as concealer, lip color, and the like. In some embodiments, the cosmetic product 100 does not include the formulation 102, and in such embodiments includes the packaging system 110 (without formulation), and optionally one or more additional elements such as a tutorial, a software application, a carrying case, an applicator, and/or other element.

The packaging system 110 is generally configured to store the formulation 102, and includes a container 112 suitable for storing a volume of liquid formulation, an applicator 114 configured to hold and apply the formulation 102, and a wiper assembly 130 configured remove excess formulation 102 from and/or distribute the formulation 102 on the applicator 114. In some embodiments, the applicator 114 is disposed on an optional cap 116, for example, integrally formed with a threaded cap 116 as a single molded or co-molded part.

The container 112 is a generally hollow packaging (e.g., a bottle) having a cavity 118 configured to store the formulation 102, and a mouth 120 in fluid connection with the cavity 118. Suitable containers generally have a volume ranging from about 5 ml to about 50 ml, however this is not intended to limit the scope of the present disclosure. The container 112 is generally formed from a thermoplastic polymer such as polypropylene, polyethylene, or the like. In some embodiments, the mouth 120 has an inner diameter of 8.0 mm to 12.0 mm.

The applicator 114 is generally a brush having a plurality of bristles 122 suitable for applying the formulation 102 to a human user. Representative applicators 114 include those describes in U.S. patent application Ser. No. 16/118,893, filed Aug. 31, 2018, which is herein incorporated by reference in its entirety for all purposes.

Figure 2:
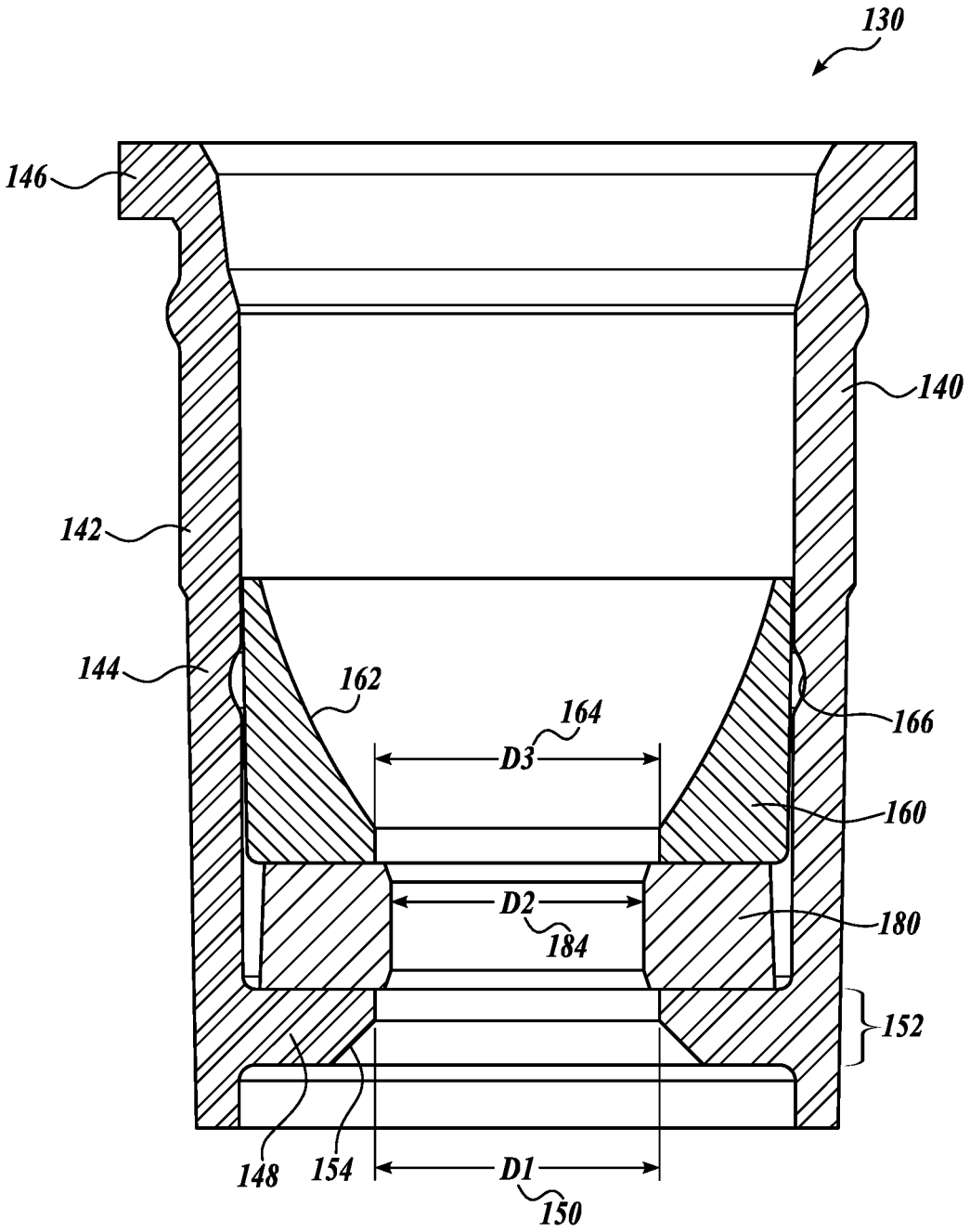
FIG. 2 shows a front elevation section view of a wiper assembly of the cosmetic product of FIG. 1.

As shown in FIG. 1 and FIG. 2, the wiper assembly 130 is configured for insertion into the mouth 120 of the container 112 and may be sold separately from the container 112 and/or from the applicator 114. Thus, the wiper assembly 130 is modular. For example, the wiper assembly 130 can be retrofitted into an existing container 112, packaging system, cosmetic product, and/or product line to improve its function. Likewise, in some embodiments, wiper assembly 130 is sold with the applicator 114 and/or the cap 116, e.g., as a retrofit kit.

The wiper assembly 130 includes a wiper base portion 140 and a guide portion 160, with a soft wiping portion 180 disposed therebetween. Each of these elements is described in detail below. The combination of these portions, as well as features of the individual portions (including the soft wiping portion 180), improve distribution of the formulation 102 on the applicator 114 and a better user experience.

In the representative and non-limiting embodiment of FIG. 1 and FIG. 2, the wiper assembly 130 is a multi-piece assembly, in which the wiper base portion 140, guide portion 160, and soft wiping portion 180 are each separate elements representing different regions or zones of the wiper assembly 130. Such multi-piece assemblies have zonal material properties and dimensional features that cause micro-scale effects on a formulation-loaded applicator 114 that contribute to a better experience for a user, including more even formulation distribution and improved feel during application of the formulation 102. Thus, such wiper assemblies 130 represent an inventive step over known wipers having a single element with uniform material properties throughout. Additionally, it is unobvious to utilize a multi-piece, multi-zone, or multi-region wiper assembly 130 in view of the known disfavor of added complexity and cost of such assemblies. Furthermore, such modular wiper assemblies 130 are unobvious in view of known wipers that are integrally formed as part of a container, because a modular wiper assembly necessarily involves assembly.

Figure 4:
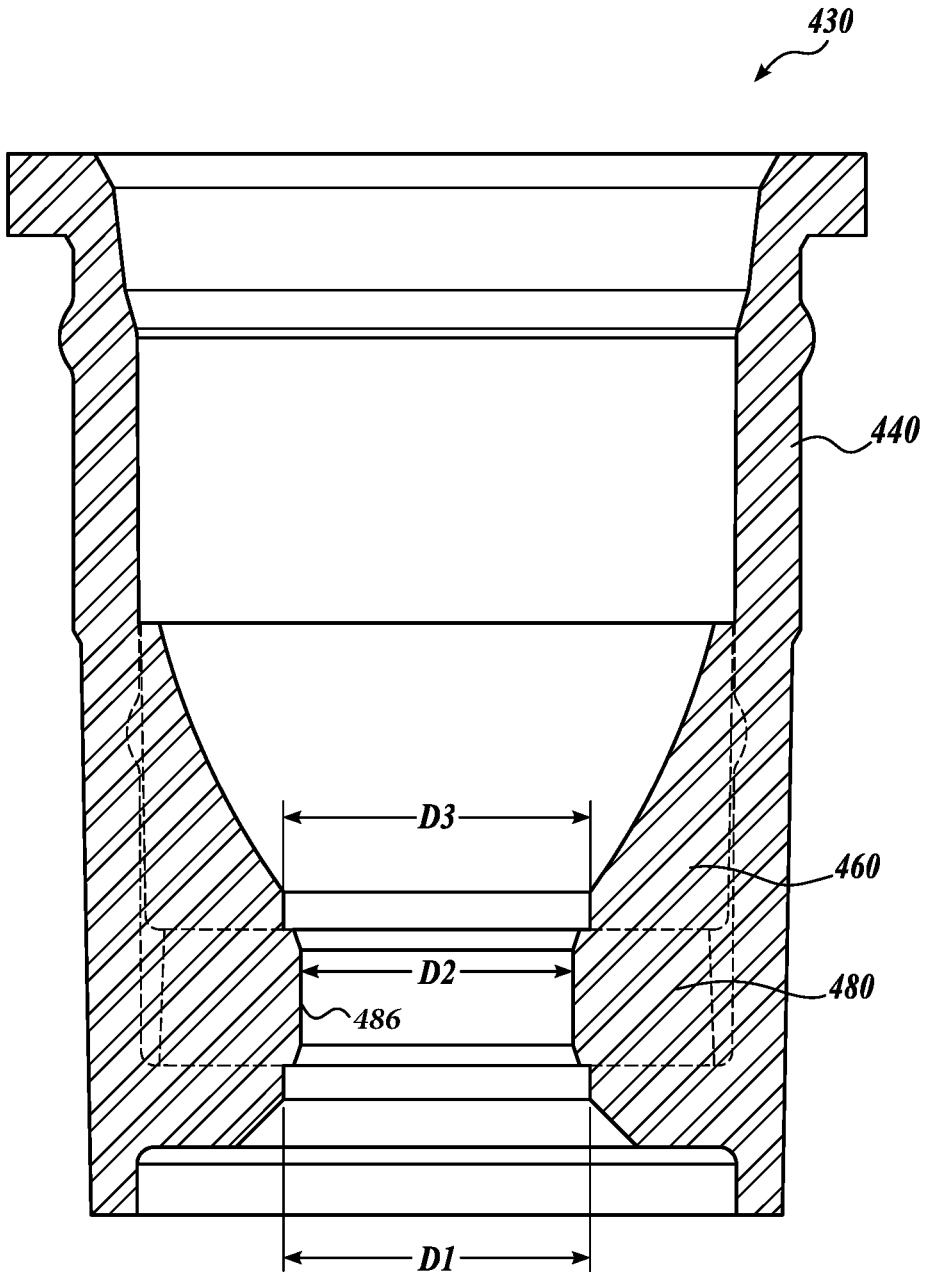
FIG. 4 shows a front elevation section view of a wiper assembly according to another representative embodiment of the present disclosure.

The wiper assembly 130 of FIG. 1 and FIG. 2 includes three separate components. However, in some embodiments (such as shown in FIG. 4, described below), the wiper assembly 130 includes fewer than three separate components. For example, in some embodiments, the wiper assembly 130 includes only the wiper base portion 140 and the soft wiping portion 180.

Further, in some embodiments, the wiper assembly 130 includes fewer than three separate components because two or more of the wiper base portion 140, guide portion 160, and the soft wiping portion 180 are formed as a single integrally-formed part having different portions (i.e., regions or zones), each portion having different dimensions and/or material properties. For example, in some embodiments, the wiper base portion 140, guide portion 160, and the soft wiping portion 180 are formed as a single integrally-formed part (e.g., an over-molded part). In such embodiments, the single integrally-formed part has at least two different portions: a soft wiping portion having at least a radially inner surface 186 with material properties corresponding to the soft wiping portion 180 described below; and a relatively rigid portion with material properties corresponding to the wiper base portion 140 and the guide portion 160 described below.

In some embodiments, the guide portion 160 and the soft wiping portion 180 are formed as a single integrally-formed part with two distinct portions: a soft wiping portion having at least a radially inner surface 186 with material properties corresponding to the soft wiping portion 180 described below; and a relatively rigid portion with material properties corresponding to the guide portion 160 described below. In such embodiments, the integrally-formed guide portion 160 and soft wiping portion 180 are configured for insertion into a separate wiper base portion 140, which forms part of the packaging system 110.

In some embodiments, the wiper base portion 140 and the soft wiping portion 180 are formed as a single integrally-formed part with two distinct portions: a soft wiping portion having at least a radially inner surface 186 with material properties corresponding to the soft wiping portion 180 described below; and a relatively rigid portion with material properties corresponding to the wiper base portion 140 described below. In such embodiments, the single integrally-formed part is configured to receive a separate guide portion 160, which forms part of the packaging system.

In still other embodiments, the wiper base portion 140 and the guide portion 160 are formed as a single integrally-formed part with material properties corresponding to the wiper base portion 140 or the guide portion 160 as described below. In such embodiments, the single integrally-formed part is configured to receive a separate soft wiping portion 180, which forms part of the packaging system.

Still referring to FIG. 1 and FIG. 2 together, the wiper base portion 140 has a body 142 configured to be disposed in the mouth 120 of the container 112. In the illustrated embodiment, the body 142 has a cylindrical outer wall 144; however, in some embodiments, the outer wall 144 is non-cylindrical (e.g., polygonal). Generally, the outer wall 144 has a shape that is complementary to the radially inner surface of the container mouth 120. In some embodiments, the outer wall 144 has a radially-outermost dimension (e.g., diameter) of 8 mm-12 mm, which corresponds to an inner diameter of the bottle mouth 120.

The wiper base portion 140 supports the guide portion 160 and soft wiping portion 180, and therefore is formed from a relatively rigid material such as a plastic (including polymers, resins, thermoplastic polymers, elastomers, co-elastomers, polymers, co-polymers, and blends or combinations thereof, etc., degradable or biodegradable plastics materials, oxo-biodegradable plastics, bio-based polymers, etc., blends, co-polymers, and/or derivatives thereof).

To prevent the wiper base portion 140 from falling into the cavity 118, the body 142 has a retention portion (here, an upper flange portion 146). In some embodiments, the retention portion additionally or alternatively includes a detent, a latch, or the like. In some embodiments, the outer wall 144 has a tapered shape that is larger at the upper end, such that the wiper base portion 140 is retained within the mouth 120 by friction fit when fully inserted.

The wiper base portion 140 includes an annular lower flange portion 148 that is integrally formed with the outer wall 144 proximal to a lower end thereof (i.e., the end that is first inserted into the container 112). Together, the outer wall 144 and the lower flange portion 148 define an inner cavity in which the guide portion 160 and soft wiping portion 180 are configured to fit. The lower flange portion 148 supports the guide portion 160 and the soft wiping portion 180, and prevents those portions from being pushed into the cavity 118 when the applicator 114 is inserted into the container 112.

Referring to FIG. 2 and FIG. 1 together, the lower flange portion 148 is generally characterized by its inner diameter 150 (D1) and its flange thickness 152. The inner diameter 150 D1 is large enough to permit passage of the applicator 114 therethrough. For example, in some embodiments, the inner diameter 150 D1 is sized such that a shaft of the applicator 114 passes freely therethrough, but the bristles 122 of the applicator 114 brush against the inner edge 154 when the applicator 114 is withdrawn. The inner diameter 150 D1 is also a function of the inner diameter 184 (D2) of the soft wiping portion 180. For example, the inner diameter 150 D1 is greater than the inner diameter 184 D2 of the soft wiping portion 180. Thus, the soft wiping portion 180 forms a smaller aperture than the lower flange portion 148, and consequently the bristles of the applicator 114 have more contact with the soft wiping portion 180 than the lower flange portion 148.

In some embodiments, the inner diameter 150 D1 is 0.1 mm-1.0 mm (e.g., 0.5 mm) greater than the inner diameter 184 D2 of the soft wiping portion 180. Additionally or alternatively, in some embodiments, the inner diameter 150 D1 is greater than, but no more than 30 percent greater than, the inner diameter 184 D2 of the soft wiping portion 180. This dimensional relationship enables the soft wiping portion 180 to protrude (in a radially inward direction) further into the mouth 120 than the lower flange portion 148, yet enables the lower flange portion 148 to provide sufficient support for the soft wiping portion 180 to ensure the soft wiping portion 180 does not fall into the cavity 118 of the container 112. If the inner diameter 150 D1 is more than 1.0 mm greater than the inner diameter 184 D2, the wiper assembly 130 experiences performance degradation, namely the soft wiping portion 180 is prone to falling into the cavity 118 or getting pushed into the cavity 118 by the applicator 114. In some embodiments, the inner diameter 150 D1 is more than 1.0 mm greater than the inner diameter 184 D2; however, in such embodiments, the lower flange portion 148 is joined with the soft wiping portion 180 by an adhesive or includes a retention member (e.g., a barb) to prevent the soft wiping portion 180 from falling into the cavity 118.

The flange thickness 152 generally ranges from 0.25 mm-1.0 mm, and—in connection with the inner diameter 150 D1 described above—influences the efficacy of the lower flange portion 148. In some embodiments, the flange thickness 152 ranges from 0.25 mm-1.0 mm and the inner diameter 150 D1 is 0.1 mm-1.0 mm (e.g., 0.5 mm) greater than the inner diameter 184 D2 of the soft wiping portion 180. In some embodiments, the flange thickness 152 ranges from 0.25 mm-1.0 mm and the inner diameter 150 D1 is 0.1 mm-1.0 mm (e.g., 0.5 mm) greater than, but no more than 30 percent greater than, the inner diameter 184 D2 of the soft wiping portion 180.

The lower flange portion 148 has an inner edge 154 configured to contact bristles of the applicator 114 when withdrawn through the wiper assembly 130. In some embodiments, the inner edge 154 is chamfered as shown in FIG. 1 and FIG. 2. Advantageously, the chamfered inner edge 154 helps center the applicator 114 as it is withdrawn through the wiper assembly 130, and also reduces the pulling force to remove the applicator 114, for an improved user experience. In some embodiments, the inner edge 154 is not chamfered.

Referring still to FIG. 1 and FIG. 2 together, the guide portion 160 is an annular insert that guides and centers the applicator 114 before its bristles 122 are inserted through the soft wiping portion 180. The guide portion 160 also holds the soft wiping portion 180 in place. The guide portion 160 is disposed in the cavity formed by the outer wall 144 of the wiper base portion 140, on an opposite side of the soft wiping portion 180 from the lower flange portion 148. The guide portion 160 has a tapered inner surface 162 (e.g., a frustoconical surface) that narrows from a larger inner diameter near the mouth end to a smaller inner diameter 164 D3 at the opposite end that lies adjacent the soft wiping portion 180. Some embodiments of the wiper assembly 130 do not include a guide portion, for example but not limited to the wiper assemblies 530 and 630 of FIGS. 5 and 6, respectively.

The inner diameter 164 D3 is generally larger than the inner diameter 184 D2 of the soft wiping portion 180. In some embodiments, the inner diameter 164 D3 has any one or more of the dimensional characteristics of the inner diameter 150 D1 of the lower flange portion 148 described above. In some embodiments, the inner diameter 150 D1 and the inner diameter 164 D3 are different, and both are 0.1 mm-1.0 mm (e.g., 0.5 mm) greater than the inner diameter 184 D2 of the soft wiping portion 180. Additionally or alternatively, in some embodiments, the inner diameter 150 D1 and the inner diameter 164 D3 are different, and both are greater than, but no more than 30 percent greater than, the inner diameter 184 D2 of the soft wiping portion 180.

The guide portion 160 is formed from any material(s) described above with respect to the wiper base portion 140. In some embodiments, the guide portion 160 includes a retention structure 166 to retain the guide portion 160 with the cavity of the wiper base portion 140. In the illustrated embodiment, the retention structure 166 is a detent on the outer surface of the guide portion 160 that cooperates with the inner surface of the outer wall 144 of the wiper base portion 140. In some embodiments, the outer wall of the guide portion 160 has a tapered shape that is larger at the upper end, such that the guide portion 160 is retained within the wiper base portion 140 by a friction fit when fully inserted.

Figure 3:
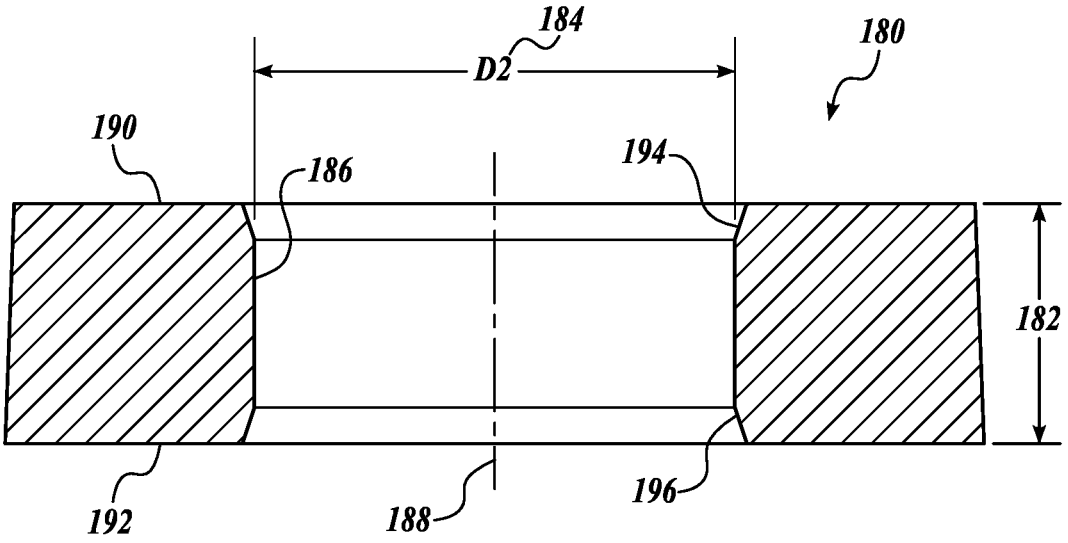
FIG. 3 shows a front elevation section view of a soft wiping portion of the wiper assembly of FIG. 2.

Referring now to FIG. 3 together with FIG. 1 and FIG. 2, the soft wiping portion 180 is an annular ring configured to contact the bristles 122 of the applicator 114 as it is inserted and retracted therethrough. The soft wiping portion 180 has material properties that cause micro-scale effects on a formulation-loaded applicator 114 that contribute to a better experience for a user, including more even formulation distribution and improved feel and formulation transfer during application of the formulation 102. For example, as the formulation-loaded applicator 114 is withdrawn through the soft wiping portion 180, the soft wiping portion 180 grabs or pulls the formulation and the bristles 122. Not only does this gently distribute the formulation on the bristles 122, but it also gently tugs or fluffs the bristles 122, advantageously preventing those bristles 122 from rebounding. Each of these effects, and the combination of these effects, contribute to a better user experience or "feel" when applying the formulation with the applicator 114.

To provide the advantageous effects above, at least the radially inner surface 186 of the soft wiping portion 180 has a Shore durometer ranging from 10 OO to 40 A, inclusive (e.g., 15 OO to 30 A). This is much softer than even rubber, which has a Shore durometer of approximately 70 A. It has been discovered that when the radially inner surface 186 has a greater Shore durometer than the range above, the advantageous micro-scale effects are not achieved. Further, it has been discovered that when the entire soft wiping portion 180 has a lower Shore durometer than the range above, it is prone to being pushed through the lower flange portion 148 into the container 112. However, in some embodiments, the radially inner surface 186 of the soft wiping portion 180 has a Shore durometer less than 10 OO. In such embodiments, the soft wiping portion 180 is reinforced with a structural element and/or at least partially formed from a second material having a Shore durometer of at least 10 OO.

In some embodiments, the entire soft wiping portion 180 has a Shore durometer ranging from 10 OO to 40 A, inclusive (e.g., 15 OO to 30 A). In some embodiments, the radially inner surface 186 has a first Shore durometer ranging from 10 OO to 40 A, inclusive, and the remainder of the soft wiping portion 180 has a second and different Shore durometer (e.g., ranging from 10 OO to 40 A, inclusive). In some embodiments, only the radially inner surface 186 has a Shore durometer ranging from 10 OO to 40 A, inclusive.

To enable the Shore durometer values above, the soft wiping portion 180 is at least partially formed from a thermoplastic elastomer (TPE), such as styrene-ethylene-butylene-styrene (SEBS) or thermoplastic polyester elastomers (e.g., HYTREL®). In some embodiments, the entire soft wiping portion 180 is formed from a same TPE, such that substantially the entire soft wiping portion 180 has the Shore durometer range above. In some embodiments, the soft wiping portion 180 is formed from a plurality of materials, and at least the radially inner surface 186 is formed from a TPE having the Shore durometer range above. In some embodiments, e.g., overmolded embodiments, only the radially inner surface 186 is formed from a TPE having the Shore durometer range above.

The soft wiping portion 180 is also characterized by its thickness 182 and its inner diameter 184 D2. To provide sufficient bristle contact, the thickness 182 of the soft wiping portion 180 ranges from 1.0 mm to 4.0 mm, inclusive. The thickness 182 is uniform about the central axis 188 in the embodiment of FIG. 3, however in some embodiments, the thickness 182 varies about the central axis 188. For example, in some embodiments, the soft wiping portion 180 has a variable thickness 182 about the central axis 188, such that the top surface 190 and/or the bottom surface 192 have a non-planar shape (e.g., an undulating shape), that engages with complementary non-planar surfaces of the guide portion 160 and/or lower flange portion 148, respectively. Such embodiments advantageously keep the elements of the wiper assembly 130 in place.

The inner diameter 184 is generally between 3.0 mm to 6.0 mm (e.g., 5.5 mm) in order to provide sufficient contact with the bristles 122. However, as discussed above in relation to the wiper base portion 140 and the guide portion 160, the inner diameter 184 D2 is related to the inner diameter 150 D1 and inner diameter 164 D3. That is, the inner diameter 184 D2 is less than both of the inner diameter 150 D1 and inner diameter 164 D3. This dimensional relationship enables the bristles of the applicator 114 to contact the radially inner surface 186 of the soft wiping portion 180, and prevents either the lower flange portion 148 or the guide portion 160 from disturbing the micro-scale effects caused by the soft wiping portion 180. To recap with reference again to FIG. 2, the inner diameter 184 D2 of the soft wiping portion 180 is 0.1 mm-1.0 mm (e.g., 0.5 mm) less than the inner diameter 150 D1 and the inner diameter 164 D3. In some embodiments, the inner diameter 150 D1 is not equal to the inner diameter 164 D3, and therefore the inner diameter 184 D2 has a different dimensional relationship to each.

The soft wiping portion 180 includes a radially-inner upper edge 194 and a radially-inner lower edge 196. In the illustrated embodiment, both are chamfered. It has been discovered that when the upper edge 194 is chamfered as shown, it advantageously reduces formulation buildup on the applicator 114 and improves the distribution of the formulation 102 on the bristles 122, for an improved user experience. Likewise, when the lower edge 196 is chamfered as shown, it advantageously centers the applicator 114 upon withdrawal, such that the bristles 122 apply more uniform pressure on the radially inner surface 186 of the soft wiping portion 180. In some embodiments, one or more of the upper edge 194 or the lower edge 196 are not chamfered, but rounded. In some embodiments, one or more of the upper edge 194 or the lower edge 196 are not chamfered or rounded, such that the radially inner surface 186 forms a direct angle with the top surface 190 and bottom surface 192.

FIG. 4 shows another representative wiper assembly 430 having all of the features described above with respect to the wiper assembly 130 of FIG. 1-FIG. 3, except that wiper assembly 430 is formed as a single integrally-formed part. That is, wiper assembly 430 includes a wiper base portion 440, guide portion 460, and soft wiping portion 480 as described above; however, the foregoing portions are a single integrally-formed part, such as formed from an overmolding process that imparts different material properties to different portions of the single integrally-formed part. As such, at least a radially inner surface 486 of the soft wiping portion 480 has a Shore durometer of 10 OO to 40 A, inclusive.

Figure 5:
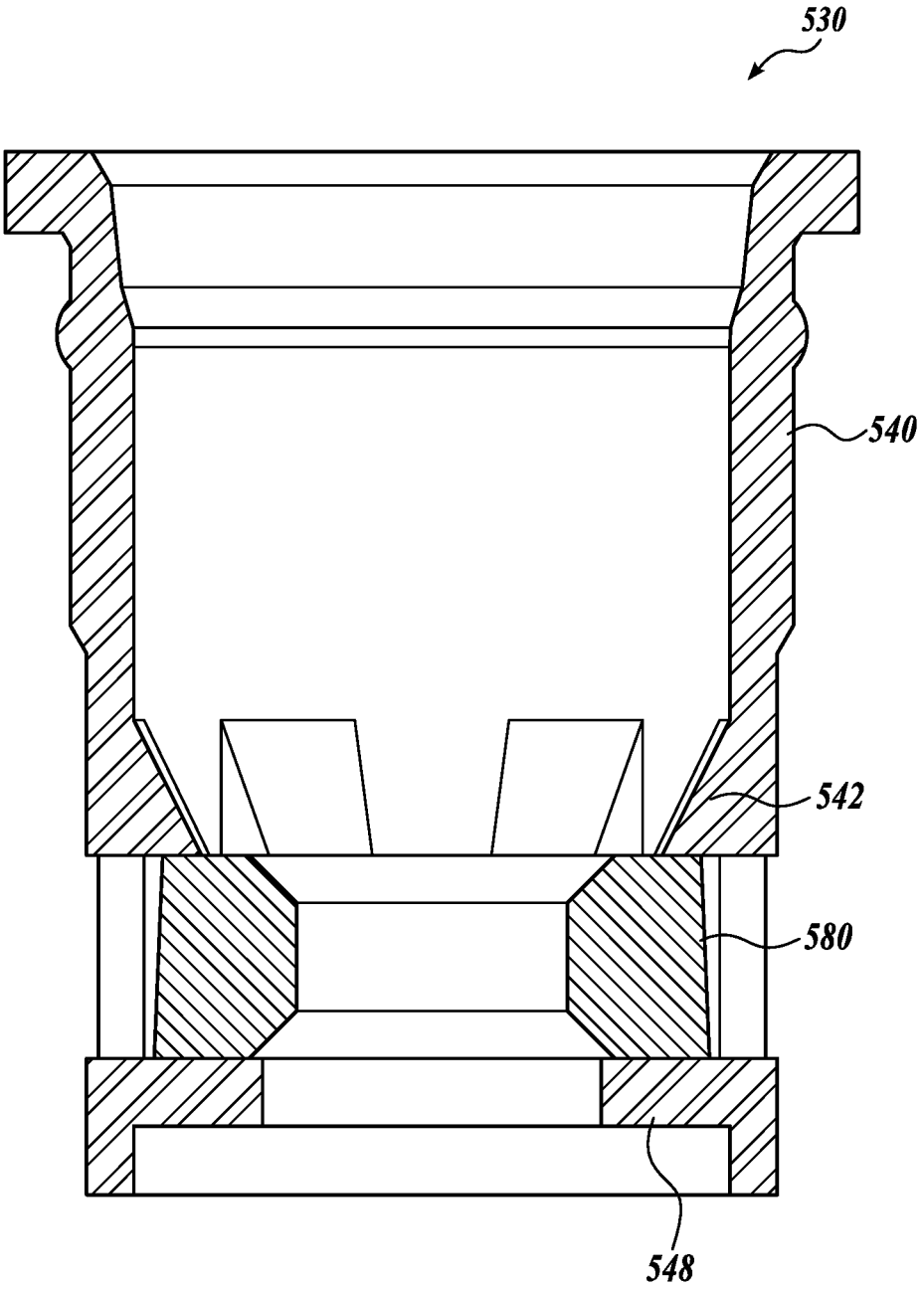
FIG. 5 shows a front elevation section view of a wiper assembly according to another representative embodiment of the present disclosure.

FIG. 5 shows another representative wiper assembly 530, which shares the features described above with respect to the wiper assembly 130 of FIG. 1-FIG. 3, except that wiper assembly 530 includes a wiper base portion 540 having at least one radially-inward extending protrusion 542 that retains the soft wiping portion 580 within and near the annular lower flange portion 548. The radially-inward extending protrusions 542 are each shaped as teeth, ramps, or ridges in the illustrated embodiment, in order to permit insertion of the soft wiping portion 580 into the wiping base portion 540 such that it resides near the annular lower flange portion 548, but to prevent inadvertent removal of the soft wiping portion 580. For reduced manufacturing cost, assembly simplicity, and/or for other advantage, some embodiments of the wiper assembly 530 do not include a guide portion, such as the guide portion 160 of FIG. 1-FIG. 3. In some embodiments, the wiper assembly 530 does include a guide portion, such as the guide portion 160 of FIG. 1-FIG. 3. The radially-inward extending protrusions 542 may be utilized in connection with any embodiment of the present disclosure.

Figure 6:
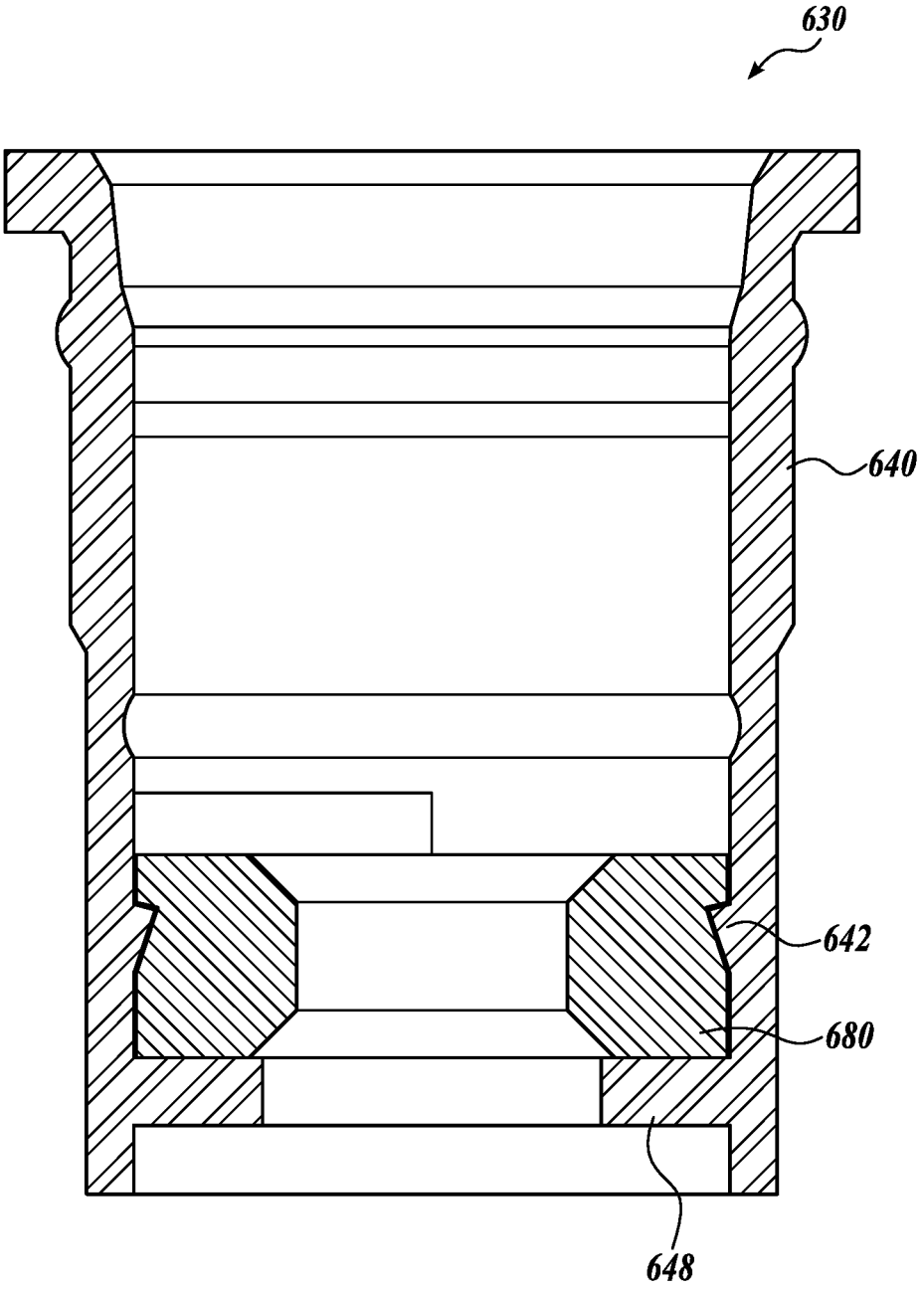
FIG. 6 shows a front elevation section view of a wiper assembly according to another representative embodiment of the present disclosure.

FIG. 6 shows another representative wiper assembly 630, which shares the features described above with respect to the wiper assembly 130 of FIG. 1-FIG. 3, except that wiper assembly 630 includes a wiper base portion 640 having at least one radially-inward extending protrusion 642 that retains the soft wiping portion 680 within and near an annular lower flange portion 648. The radially-inward extending protrusions 642 are each shaped as undercut hooks in the illustrated embodiment, and the soft wiping portion 640 has an optional complementary recess to receive the protrusions 642 (in some embodiments, the soft material of the soft wiping portion 680 conforms to the protrusions 642). These features permit insertion of the soft wiping portion 680 into the wiping base portion 640 such that it resides near the annular lower flange portion 648, but prevent inadvertent removal of the soft wiping portion 680. For reduced manufacturing cost, assembly simplicity, and/or for other advantage, some embodiments of the wiper assembly 630 do not include a guide portion, such as the guide portion 160 of FIG. 1-FIG. 3. In some embodiments, the wiper assembly 630 does include a guide portion, such as the guide portion 160 of FIG. 1-FIG. 3. The radially-inward extending protrusions 642 may be utilized in connection with any embodiment of the present disclosure.

The detailed description set forth above in connection with the appended drawings, where like numerals reference like elements, are intended as a description of various embodiments of the present disclosure and are not intended to represent the only embodiments. Each embodiment described in this disclosure is provided merely as an example or illustration and should not be construed as preferred or advantageous over other embodiments. The illustrative examples provided herein are not intended to be exhaustive or to limit the disclosure to the precise forms disclosed. Similarly, any steps described herein may be interchangeable with other steps, or combinations of steps, in order to achieve the same or substantially similar result. Generally, the embodiments disclosed herein are non-limiting, and the inventors contemplate that other embodiments within the scope of this disclosure may include structures and functionalities from more than one specific embodiment shown in the figures and described in the specification. It will be appreciated that variations and changes may be made by others, and equivalents employed, without departing from the spirit of the present disclosure. Accordingly, it is expressly intended that all such variations, changes, and equivalents fall within the spirit and scope of the present disclosure as claimed. For example, the present disclosure includes additional embodiments having combinations of any one or more features described above with respect to the representative embodiments.

In the foregoing description, specific details are set forth to provide a thorough understanding of exemplary embodiments of the present disclosure. It will be apparent to one skilled in the art, however, that the embodiments disclosed herein may be practiced without embodying all the specific details. In some instances, well-known process steps have not been described in detail in order not to unnecessarily obscure various aspects of the present disclosure. Further, it will be appreciated that embodiments of the present disclosure may employ any combination of features described herein.

The present application may include references to directions, such as "vertical," "horizontal," "front," "rear," "left,"

"right," "top," and "bottom," etc. These references, and other similar references in the present application, are intended to assist in helping describe and understand the particular embodiment (such as when the embodiment is positioned for use) and are not intended to limit the present disclosure to these directions or locations.

The present application may also reference quantities and numbers. Unless specifically stated, such quantities and numbers are not to be considered restrictive, but exemplary of the possible quantities or numbers associated with the present application. Also in this regard, the present application may use the term "plurality" to reference a quantity or number. In this regard, the term "plurality" is meant to be any number that is more than one, for example, two, three, four, five, etc. The term "about," "approximately," etc., means plus or minus 5% of the stated value. The term "based upon" means "based at least partially upon."

What is claimed is:

1. A wiper assembly for a packaging system, comprising:

a wiper base portion having a body configured to be disposed in a mouth of a container, the body having an outer wall and an annular lower flange portion extending radially inward from the outer wall, the outer wall and the annular lower flange portion defining a cavity, wherein the annular lower flange portion defines a first opening with a first diameter, wherein the annular lower flange portion has a chamfered lower edge;

a soft wiping portion contained within the cavity, the soft wiping portion having an annular shape with a radially inner surface having a Shore durometer ranging from 10 OO to 40 A, inclusive, wherein the radially inner surface forms a second opening having a second diameter, wherein the second diameter is smaller than the first diameter, wherein the radially inner surface has a chamfered lower edge disposed adjacent the annular lower flange portion; and an annular guide insert contained in the cavity on an opposite side of the soft wiping portion from the annular lower flange portion, wherein the annular guide insert has an inner surface tapering to a third diameter, wherein the third diameter is larger than the second diameter.

2. The wiper assembly of claim 1, wherein the radially inner surface has a Shore durometer ranging from 15 OO to 30 A, inclusive.

3. The wiper assembly of claim 1, wherein the first inner diameter and the third inner diameter are 0.1 mm to 1.0 mm greater than the second inner diameter.

4. The wiper assembly of claim 3, wherein the first inner diameter is different from the third inner diameter.

5. The wiper assembly of claim 1, wherein the radially inner surface of the soft wiping portion has a chamfered upper edge disposed opposite the chamfered lower edge of the soft wiping portion.

6. The wiper assembly of claim 1, wherein the first inner diameter is 0.1 mm to 1.0 mm greater than the second inner diameter.

7. The wiper assembly of claim 1, wherein the first inner diameter is not more than thirty percent greater than the second inner diameter.

8. The wiper assembly of claim 1, wherein the soft wiping portion has a thickness between 1 mm and 4 mm, wherein the second inner diameter is between 3.0 mm and 6.0 mm, wherein the first inner diameter is 0.1 mm to 1.0 mm greater than the second inner diameter.

9. The wiper assembly of claim 1, wherein the soft wiping portion is formed from a thermoplastic elastomer.

10. The wiper assembly of claim 1, wherein the wiper base portion, the soft wiping portion, and the annular guide insert are three separate components.

11. The wiper assembly of claim 1, wherein the wiper base portion and the soft wiping portion are integrally formed as a single integrally-formed part.

12. The wiper assembly of claim 11, wherein the single integrally-formed part further comprises the annular guide insert.

13. The wiper assembly of claim 11, wherein the single integrally-formed part is an overmolded part.

14. A packaging system, comprising:

a container configured to store a formulation; and the wiper assembly of claim 1 disposed in a mouth the container.

15. The packaging system of claim 14, wherein the first inner diameter and the third inner diameter are 0.1 mm to 1.0 mm greater than the second inner diameter.

16. A cosmetic product, comprising:

the packaging system of claim 14; and a cosmetic formulation disposed in the container of the packaging system.

17. A product line of cosmetic products, comprising:

a plurality of the cosmetic products of claim 16.

* * * * *